US005961708A

United States Patent [19]

Zetter et al.

[11] Patent Number: 5,961,708

[45] Date of Patent: Oct. 5, 1999

[54] INTERNAL SIZING COMPOSITION FOR PAPER

[75] Inventors: Claes Zetter; Olof Malmström, both of Turku; Markku Nurminen, Raisio, all of Finland

[73] Assignee: Raisio Chemicals Oy, Raisio, Finland

[21] Appl. No.: 09/033,658

[22] Filed: Mar. 3, 1998

Related U.S. Application Data

[63] Continuation-in-part of application No. 08/817,206, filed as application No. PCT/FI 96/00051, Jan. 25, 1996, abandoned.

[51] Int. Cl.[6] ..... C08L 3/02; C08L 3/04; C08L 3/10

[52] U.S. Cl. ..... 106/209.1

[58] Field of Search ..... 106/209.1

[56] References Cited

U.S. PATENT DOCUMENTS

| | | | |
|---|---|---|---|
| 4,606,773 | 8/1986 | Novak | 106/209.1 |
| 4,614,546 | 9/1986 | Schroer et al. | 106/209.1 |
| 4,861,376 | 8/1989 | Edwards et al. | 106/209.1 |
| 5,658,378 | 8/1997 | Tsai et al. | 106/209.1 |

*Primary Examiner*—David Brunsman
*Attorney, Agent, or Firm*—Pollock, Vande Sande & Amernick

[57] ABSTRACT

The present invention relates to a size composition of improving the water repellency of paper in papermaking by virtue of adding prior to web formation to the pulp slurry such a sizing dispersion that contains at least a ketene dimer compound as a hydrophobic sizing agent, and further contains colloidal starch in an amount which is at least 150% by weight of the hydrophobic sizing agent. The invention is particularly applicable for improving the water repellency of paper containing calcium carbonate as the filler.

29 Claims, No Drawings

INTERNAL SIZING COMPOSITION FOR PAPER

CROSS-REFERENCE TO RELATED APPLICATION

This is a continuation in part of application Ser. No. 08/817,206 of Apr. 11, 1997, now abandoned, based on PCT/FI96/00051 of Jan. 25, 1996.

FIELD OF THE INVENTION

The present invention relates to a composition for improving the hydrophobicity of printing papers by means of internal sizing of the paper. A particular object of the invention is to improve the hydrophobicity of paper by means of using a ketene dimer compound as a hydrophobic sizing agent.

BACKGROUND OF THE INVENTION

The purpose of improving the hydrophobicity is to impart the paper web a degree of sizing that makes the paper compatible with ink-jet printing.

The resistance properties of paper to wetting and penetration are conventionally enhanced in papermaking by means of internal sizing, where during the paper making process compounds are added into the paper pulp which increase the hydrophobicity of the paper fibres.

Printing papers, which are mainly used as office paper in various types of copiers, printers and printing machines, are expected to exhibit high brightness among other properties, as well as acceptable permanence in archive document use. The brightness and archiving permanence properties can be affected through the type of filler used for the paper. One filler compatible with the abovedescribed requirements is precipitated calcium carbonate (PCC). However, a problem is involved in the use of this filler, because it requires a neutral or alkaline environment for a proper functioning. Such a process condition excludes the use of conventional hydrophobic sizing of paper by means of the rosin-alum system. As known in the art, this drawback is overcome by the use of hydrophobic sizes based on ketene dimer compounds such as alkyl, alkenyl, aryl and alkaryl ketene dimer sizes.

Such sizes are, however, hampered by other problems particularly in paper grades intended for office printing use that have to be compatible with different printer types. Namely, besides a application in ink-jet printing, the same paper grade should do as copier paper, laser printing paper, etc. When optimized for the above-mentioned ink-jet use, the base paper must be sized with such great amounts of ketene dimer combination sizes that ultimately the size causes problems in the alternative printer types. In practice, the degree of sizing may amount to, e.g., 0.1–0.2% of fiber dry weight in the web.

Over time, ketene dimer compounds have been found problematic as a sizing agent due to their migration tendency in the finished paper. Owing to such migration, the content of the ketene dimer compound is enriched in the outer layers of the sheet. Migration is made possible by the fact that the curing reactions of ketene dimer compounds are so slow that the added agents lose their migration capability not earlier than after a few days from the finishing of the sheet.

A disadvantageous effect of ketene dimer compound enrichment is easier slippage of the sheet surface, i.e., decrease of surface frictional resistance. Reduced friction is harmful particularly in printing and copier paper grades, because the lowered threshold of slippage causes paper handling problems in printing or copying machines whose paper transfer elements fail to provide their intended function on slippery paper grades.

Also the above-mentioned filler, namely, the precipitated calcium carbonate causes indirectly easier slippage of the sheet. This is because this filler has been found to disturb the hydrophobic sizing process, whereby greater amounts of size must be used per unit weight of fiber in comparison to the use of another type of filler.

On the other hand, it has been found that ketene dimer based sizing fails to bond completely on the fiber during sheet formation, whereby a fraction of the sizing agent remains circulating in the system and or this fraction a portion bonds later on the fiber. When circulating in the system, the sizing compound is subjected to the hydrolyzing effect of water resulting in a partial decomposition of the sizing compound into corresponding ketenes. Also a fraction of the size retained in the base web will remain unbonded to the fiber, whereby the size may undergo hydrolyzation by the moisture contained in the web. These phenomena are harmful particularly in copier use, where the sheet is subjected to heating in the copying machine, whereby the decomposition of unbonded size and its migration, along with the moisture released from the sheet, to the surface of the sheet are accelerated. Resultingly, the machine parts of the copier may become contaminated and the copying result deteriorated. To eliminate these risks, determination of residual ketene content in paper grades intended for copier use has been instigated.

SUMMARY OF THE INVENTION

According to the present invention, an essential improvement has now been achieved to overcome the above-described problem by virtue of performing hydrophobic sizing using for the internal sizing a composition consisting of a ketene dimer compound, possibly together with some other hydrophobizing compound, whereby the hydrophobizing compound(s) is (are) dispersed in water together with degraded starch in a weight ratio of at least 1:1. Preferably the ratio is from 1:1.5 to 1:2.5.

DETAILED DESCRIPTION OF THE INVENTION

Herein, it has firstly been noted that ketene dimer compound used as the hydrophobic sizing agent is better bonded to the fibre, and, secondly, that the precipitated calcium carbonate used as the filler has no essential disturbing effect on the sizing process. Owing to the latter fact, less is needed, whereby said smaller amount of the hydrophobic sizing agent can be retained close to the fibre in an improved manner until the curing of the hydrophobic sizing agent has proceeded to a level preventing migration. Additionally, it was found that the invention offered improved ink penetration properties with respect to the water penetration. This effect is of extremely high importance to the quality of ink-jet printing that is becoming ever more widely used.

The invention has furthermore been found applicable in cases where the ketene dimer compound employed as a hydrophobic sizing agent in the sizing of paper is complemented with other conventional hydrophobic sizing agents such as alkylated succinic anhydride and/or rosin.

The invention is next explained with the help of the following examples elucidating the function of the invention in its different embodiments.

EXAMPLE 1

A pilot-scale test run was carried out, in which internal sizing was performed for a finepaper grade with added precipitated calcium carbonate (PCC) as the filler. The filler (Albacar LO, Specialty Minerals, Inc) was used at 22% level by fiber dry weight. The fiber in the base web was 75% birch fiber beaten to 23 SR° freeness and the fiber slurry was adjusted to pH 7. The rest, 25%, of the fiber was pine fiber equally beaten to 23 SR° freeness and fiber slurry also adjusted to pH 7. Internal sizing of the paper web was performed using Raisamyl 135 starch (cationic wet-end starch, DS 0.035, Raisio Chemicals, Raisio Finland) at 5 kg/ton pulp addition rate. The basis weight of the produced paper web was 80 g/m$^2$. The paper machine was run at 60 m/min resulting in a production rate of 4.08 kg/min. The retention agent used in the process was BMA 590 (colloidal sodium silicate, Akzo Nobel) at an addition rate of 300 g/ton pulp. The paper web was also surface sized using Raisamyl 406 LO starch (oxidized and cationized surface size starch, Raisio Chemicals, Raisio, Finland) at 6% solids addition level. The hydrophobic compound used as a sizing agent was alkyl ketene dimer (AKD, Raisio Chemicals, Raisio, Finland).

The test runs were performed using the different formulations or hydrophobic size listed below for internal sizing:

1. Conventional AKD sizing with Raisafob 940 (Raisio Chemicals, AKD+cationized starch) in which the amount of starch protective colloid addition was not more than 20% by weight of sizing agent.
2. AKD sizing, amount of starch protective colloid addition 50% by weight of sizing agent.
3. AKD sizing, amount of starch protective colloid addition 100% by weight of sizing agent.
4. AKD sizing, amount of starch protective colloid addition 150% by weight of sizing agent.
5. AKD sizing, amount of starch protective colloid addition 200% by weight of sizing agent.
6. AKD sizing, amount of starch protective colloid addition 250% by weight of sizing agent.
7. AKD sizing, amount of starch protective colloid addition 300% by weight of sizing agent.
8. AKD sizing, amount of protective colloid addition using PEI (polyimin KK)* in an amount of 200% by weight of sizing agent.

Notes: *)Polyethylene imine

The tests were run using two levels of sizing agent, namely, adding the sizing agent (AKD) at 0.1% and 0.2% levels by fiber dry weight.

The starch used as the protective colloid component was Raisamyl 150 which is a degraded special starch grade (Raisio Chemicals, Raisio, Finland).

The degree of sizing in the manufactured papers were tested by measuring the water absorbance of the paper sheets in the Cobb$_{60}$ test from the sheet surface, while the ink penetration of the sheets was measured using the Schröder test. Also the brightness of test sheets was measured. The test runs gave the following results:

| | Cobb$_{60}$ test [g/m$^2$] | | Schröder test (100 --> 90%, s) Amount of size | | Brightness |
|---|---|---|---|---|---|
| Test no./ | 0.1% | 0.2% | 0.1% | 0.2% | [%] |
| 1 (20% starch) | 78.2 | 28.3 | 0 | 10 | 92.7 |
| 2 (50% starch) | 76.3 | 28.1 | 1 | 11 | 92.6 |
| 3 (100% starch) | 41.5 | 26.6 | 2 | 15 | 92.7 |
| 4 (150% starch) | 29.3 | 20.2 | 5 | 135 | 92.8 |

-continued

| | Cobb$_{60}$ test [g/m$^2$] | | Schröder test (100 --> 90%, s) Amount of size | | Brightness |
|---|---|---|---|---|---|
| Test no./ | 0.1% | 0.2% | 0.1% | 0.2% | [%] |
| 5 (200% starch) | 25.0 | 18.4 | 18 | 248 | 93.0 |
| 6 (250% starch) | 24.8 | 18.3 | 20 | 253 | 92.9 |
| 7 (300% starch) | 24.7 | 18.2 | 21 | 255 | 93.0 |
| 8 (200% PEI) | 28.8 | 18.1 | 21 | 262 | 91.1 |

From the above results it can be seen that, at an addition rate of the sizing agent of 0.1% by fiber dry weight, a sufficient addition rate of the protective starch colloid is at approximately 200% level by hydrophobic sizing agent solids weight, whereby this combination provides such a Cobb$_{60}$ value of less than 25 g/m$^2$ that conventionally is considered to represent a sufficient level of sizing. For the larger, 0.2 wt. %, addition rate of the sizing agent, the corresponding water repellency value is attained using an addition rate of the protective starch colloid component as low as 100% of the hydrophobic sizing agent solids weight. Also polyethylene imine (PEI) was found (test run no. 8) to act as a protective colloid component at the same addition rate (200%), however, with the penalty that paper brightness is adversely affected particularly in grades manufactured using optical brighteners. The ink penetration property of the paper web is improved significantly up to 200% addition rate of the protective starch colloid component, whereafter this property at higher addition rates stays approximately at the same level as when using PEI.

EXAMPLE 2

A production-scale test run was performed on a finepaper machine by making paper at 78 g/m$^2$ basis weight. The paper was manufactured using pulp comprised in 60/40 ratio of birch to pine fiber. The amount of filler added to the base web was at 22% level by fiber dry weight, whereby 70% of the filler was precipitated calcium carbonate (PCC, Albacar LO) and 30% of ground $CaCO_3$. The retention system was formed by corn starch and an anionic component (Compozil).

The AKD sizing was applied using two different formulations:

1. Raisafob 940, conventional AKD sizing, amount of protective colloid component not more than 20% of sizing material dry weight.
2. Raisafob 500, AKD sizing using starch as the protective colloid component with an amount increased to 200% of size dry weight. The starch added as the protective colloid component was Raisamyl 150 EH.

The test runs were carried out using AKD sizing at 0.12% level by fiber dry weight. Tests were performed in multiple series using both of the above sizing formulations in identical conditions to eliminate random error from the results. The test data is listed in the table below:

| Test run no. | AKD type | $Cobb_{60}$ felt side | $Cobb_{60}$ wire side | Schroder test (100 → 91%, s] felt side | Coefficient of friction static | Coefficient of friction kinetic | Ink-jet, black-and-white: black density (100%) | Ink-jet, black-and-white: ink drying time [s] | Ink-jet, black-and-white: wicking mean | Ink-jet, color: ink drying time [s] | Ink-jet, color: wicking mean | Ink-jet, color: color-to-color bleeding | Ink-jet, color: black density (100%) |
|---|---|---|---|---|---|---|---|---|---|---|---|---|---|
| 77 | RF940 | 21.7 | 22.2 | 59 | 0.79 | 0.54 | 1.60 | 9 | 4 | 19 | 10 | 8 | 1.08 |
| 79 | RF940 | 20.7 | 21.5 | 49 | 0.67 | 0.50 | 1.64 | 11 | 4 | 20 | 10 | 8 | 0.98 |
| 81 | RF940 | 21.2 | 20.7 | 54 | 0.77 | 0.54 | 1.64 | 9 | 6 | 18 | 10 | 8 | 0.97 |
| 84 | RF940 | 20.4 | 20.6 | 78 | 0.75 | 0.58 | 1.76 | 12 | 4 | 15 | 10 | 8 | 1.03 |
| 87 | RF500 | 19.9 | 19.8 | 205 | 0.76 | 0.53 | 1.91 | 22 | 2 | 109 | 10 | 8 | 1.38 |
| 89 | RF500 | 19.3 | 19.0 | 181 | 0.75 | 0.53 | 1.93 | 14 | 2 | 144 | 10 | 8 | 1.38 |
| 91 | RF500 | 19.4 | 19.2 | 209 | 0.82 | 0.57 | 1.94 | 21 | 2 | 154 | 10 | 8 | 1.42 |
| 93 | RF500 | 19.4 | 19.4 | 203 | 0.81 | 0.57 | 1.90 | 19 | 2 | 157 | 10 | 8 | 1.46 |
| 95 | RF500 | 19.5 | 18.9 | 277 | 0.78 | 0.60 | 1.96 | 24 | 2 | 172 | 10 | 8 | 1.51 |

As is evident from the above results, sizing properties are clearly improved by the use of RF 500 and the coefficient of friction is simultaneously retained at the same level or even improved. The ink-jet printing tests indicate that the use of RF 500 gives positively improved black-and white printing results over conventional sizing, and simultaneously, the ink-jet color printing test remains unchanged, which indicates that the level of sizing herein is overproportioned for ink-jet color printing.

EXAMPLE 3

A production-scale test run was carried out in which the following sizing formulations were compared:

| | |
|---|---|
| 1. Raisafob 940 | AKD sizing, amount of starch protective colloid addition not more than 20% by weight of sizing agent. |
| 2. Raisafob 500 | AKD sizing, amount of starch protective colloid addition 200% by weight of sizing agent. |

The paper made herein was an office paper grade intended for multipurpose use. The production target values for the paper grade were set as follows: residual ketone content less than 0.4 mg/g (for copier use), black density greater than 1.2 in B/W printing on ink-jet printers and combination black density greater than 0.75 in multicolor printing.

Test run conditions:

| | |
|---|---|
| Paper grade: | Office paper (multipurpose) |
| Basis weight: | 80 $g/m^2$ |
| Base web composition: | 70% birch fiber at 23 °SR freeness<br>30% pine fiber at 23 °SR freeness |
| Filler: | Precipitated calcium carbonate (PCC) |
| Retentionsystem: | Two-component formulation of a polymer (cationic polyakrylamide) and bentonite |
| Surface sizing: | Raisamyl 408 starch (Raisio Chemicals) + 1.5 kg styrene acrylate polymer/ton pulp solids |

-continued

| | |
|---|---|
| Paper machine speed: | 980 m/min |
| AKD addition rate: | 1 kg AKD/ton pulp solids, or alternatively, 1.4 kg |

Test results:

| Sizing agent | Addition rate [kg/ton] | $Cobb_{60}$ [$g/m^2$] | Ink penetration HST 80 [%, s] | Residual ketone [mg/g] | Black density, B/W printing, felt side | Black density, comp. color printing, felt side |
|---|---|---|---|---|---|---|
| RF940 | 1 | 25 | 80 | 0.41 | 1.02 | 0.64 |
| RF940 | 1.4 | 23 | 153 | 0.68 | 1.22 | 0.82 |
| RF500 | 1.4 | 21 | 238 | 0.27 | 1.38 | 0.90 |

As is evident from the above results, the sizing properties are clearly improved by the use of RF 500. Additionally, the residual ketene content remains below the set target value. Also the density target values set for ink-jet printing are exceeded. By contrast, using the RF 940 sizing formulation with a low protective colloid content it is not possible to meet the upper limit set for the residual ketone content. Hence, the paper made in this process is not suited for the intended copier use. If the size addition rate is reduced to a level of 1 kg/ton pulp solids, the RF 940 sizing formulation may marginally meet the level set for the maximum allowable residual ketone content, however, with the penalty of not meeting required ink penetration criteria.

The invention has further been found suitable for use in such paper sizing applications in which a fraction of the hydrophobic sizing agent is composed, besides of AKD, additionally of another sizing agent suited for improvement of water repellency such as alkenyl succinic anhydride (ASA). However, as ASA sizing formulations do not offer hydrophobic properties as effective as those of AKD sizing formulations, they must be used in larger amounts to achieve comparable ink-jet printability qualities. Due to the staining problems caused by the required large addition rates of ASA sizing in papermaking, this sizing approach appears less favored. However, because the use of an ASA sizing formulation in the present application would give a low residual ketene content in the finished sized paper, which is a definite benefit when using the paper in copiers. The well-known problematic properties of this sizing agent require that the sizing furnish be prepared in the immediate vicinity of the papermaking process. In the following example, the behavior of this sizing formulation type is described.

EXAMPLE 4

A production-scale test run was carried out to compare the behavior of the following sizing formulations:

| | |
|---|---|
| 1. Raisafob 500 | AKD sizing, amount of starch protective colloid addition 200% by weight of the ketene dimer. |
| 2. Raisafob MF | ASA sizing dispersed in bulk sizing starch Raisamyl 135 in an ASA/starch ratio of 1:2. |
| 3. Raisafob 500 | AKD sizing plus Raisafob MF, + Raisafob MF added separately. |
| 4. New sizing | AKD/Raisafob 500 type sizing formulation dispersion + ASA disperse therein in AKD/ASA ratio of 50/50. |

The paper made herein was a office paper grade intended for multipurpose use. The production target values for the paper grade were set as follows: ketene content less than 0.4 mg/g (for copier use), black density greater than 1.2 in B/W printing on ink-jet printers and combination black density greater than 0.75 in multicolor printing.

Test run conditions:

| | |
|---|---|
| Paper grade: | Office paper (multipurpose) |
| Basis weight: | 80 g/m$^2$ |
| Base web composition: | 70% birch fiber at 23 SR° freeness<br>30% pine fiber at 23 SR° freeness |
| Filler: | Precipitated calcium carbonate (PCC) at 20% level by fiber dry weight |
| Retention system: | Two-component formulation of a polymer and bentonite |
| Surface sizing: | Raisamyl 408 starch + 1.5 kg styrene acrylate polymer/ton pulp solids |
| Paper machine speed: | 980 m/min |
| AKD addition rate: | 1.4 kg/ton pulp solids (as AKD, combined with Raisafob RF500) |
| ASA addition rate: | 1.4 g/ton pulp solids (combined with Raisafob MF) |
| AKD/ASA addition rate: | 0.7 kg + 0.7 kg/ton pulp solids (combined with Raisafob RF500 and Raisafob MF, respectively, using separate additions) |
| New sizing formulation: | 0.7 g + 0.7 kg/ton pulp solids (ASA dispersed in Raisafob RF500) |

Test results:

| Sizing agent | Addition rate [kg/ton] | Cobb$_{60}$ [g/m$^2$] | Ink penetration HST 80 [%, s] | Residual ketone [mg/g] | Black density, B/W printing, felt side | Black density, comp. color printing, felt side |
|---|---|---|---|---|---|---|
| RF500 | 1.4 | 22 | 24 | 0.29 | 1.32 | 1.06 |
| RF MF | 1.4 | 23 | 122 | 0 | 1.14 | 0.58 |
| RF 500 + RF MF | 0.7 + 0.7 | 22 | 173 | 0.15 | 1.18 | 0.78 |
| New formulation | 0.7 + 07 | 21 | 208 | 0.15 | 1.21 | 0.86 |

As is evident from the above results, the requirements set for the compatibility of the manufactured paper with ink-jet printability are not met using ASA sizing alone. Admittedly, the paper exhibits zero residual ketone content. The novel type of combination sizing formulation is capable of meeting the requirements set for both copier and ink-jet printing use. The results also show the effect of the hydrolysis of ASA on the sizing efficiency when the ASA is dispersed in warm starch used as the internal size and then added separately. With regard to ink-jet printing, also herein the novel sizing formulation gives better density values than those achieved using ASA alone.

In a similar fashion as combining with ASA sizing, the AKD dispersion based on Raisafob 500 may be combined with rosin sizing. In general, rosin imparts good friction properties and does not make the paper slippery as typically is the case using AKD sizing alone. This improvement is described in the example below.

EXAMPLE 5

In this example a pilot-scale paper machine was employed to compare the water repellency of a paper web achievable by three different sizing formulations: first, using conventional AKD sizing (Raisafob 940), second, using AKD combined a protective colloid component formed by Raisamyl 150 EH in an amount of 200% of sizing agent dry weight, and third, testing the effect according to the present invention of the protective colloid component (Raisamyl 150 EH, 200% by sizing agent dry weight) combined with AKD plus rosin used as a hydrophobic sizing agent. The dry weight ratio of AKD to rosin was 50/50.

The base web was formed from a pulp comprising 75% of birch fiber at 23 SR° freeness and 25% of pine fiber at 23 SR° freeness. Bulk sizing of the paper web was performed using Raisamyl 125 at 0.5% addition level by fiber dry weight. The retention system was formed by a two-component system in which Percol 162 (cationic polyacrylamide, Allied Colloids) was added at 0.02% level and bentonite at 0.2% level by fiber dry weight. The paper web was surface sized using Raisamyl 408 SP, which was added at 5% level by fiber dry weight. The amount of filler added to the base web was kaolin at 20% level by fiber dry weight. The pulp slurry pH was in the range 6.9–7.0. The sheets produced were measured for water absorbance in the Cobb$_{60}$ test on both the felt and wire sides of the sheet. Similarly, the static and kinetic coefficients of friction were determined. Also the addition rate of surface sizing was monitored. The test results are given in the table below.

| Sizing formulation | Raisafob 940 | AKD + Raisamyl 150 EH | AKD + rosin + Raisamyl 150 EH |
|---|---|---|---|
| Addition rate | 0.12 | 0.12 | 0.20 |
| Cobb$_{60}$, felt side | 18.6 | 18.3 | 28.1 |
| Cobb$_{60}$, wire side | 20.1 | 20.2 | 31.9 |
| Static coeff. of | 0.395 | 0.428 | 0.465 |

-continued

| Sizing formulation | Raisafob 940 | AKD + Raisamyl 150 EH | AKD + rosin + Raisamyl 150 EH |
|---|---|---|---|
| friction | | | |
| Kinetic coeff. of friction | 0.222 | 0.229 | 0.355 |
| Surface size addition rate | 1.9 l/min | 1.8 l/min | 1.4 l/min |

As is evident from the above results, the best sizing properties are achieved using the AKD sizing dispersion containing Raisamyl 150 EH starch as the protective colloid component. Also the friction properties of the sheet are improved over a sheet sized using a conventional AKD sizing formulation (Raisafob 940). The results also lndicate that a sizing dispersion having the AKD/rosin combination as the sizing agent in the protective colloid also performs excellently particularly in terms of its friction values, which refer to minimal migration tendency of the sizing agent in spite of the slightly increased size addition rate over that used in the comparative test runs. Admittedly, the sizing efficiency in terms of water repellency herein remains lower than that achieved in the comparative test runs.

EXAMPLE 6

In a test conducted on a pilot paper machine was studied the behaviour of dispersions owing a low protective starch colloid content, and a high protective starch colloid content, respectively, as hydrophobizing sizes for paper. Especially a comparison was made, whether any difference can be found in the functioning of sizes prepared either by homogenization the protective starch together with the AKD, or by adding a proper starch subsequently into the disperged AKD.

The paper grade was a fine paper with a basis weight of 80 g/m$^2$. The machine speed was 80 m/min and the production capacity was 5.55 kg/min.

The pulp used: 75% of birch pulp (23 °SR, pH 7) and 25% of pine pulp (23 °SR, pH 7).

The filler content was 22% and it consisted of precipitated calsium carbonate (PCC).

Stock starch consisted of Raisamyl 150 E in an amount of 0.5% of the fiber.

Retention aids: Cationic polyacrylamid in an amount of 200 g/ton.

Surface size: Cationic oxidated starch, Raisamyl 404, as a 6% solution.

Internal sizes consisted of different AKD sizes in an amount of 0.12% of the fiber.

Raisafob 500, containing 200% of a protective colloid.

Raisafob 940, a conventional AKD dispersion with a protective colloid content of 20%.

Raisafob 940 and added starch. A conventional AKD dispersion was subsequently admixed with a starch suitable as a protective colloid (same starch as used in the production of Raisafab 500), in an amount corresponding to the 200% protective colloid amount.

The results of this pilot test are given in the following table:

| Matured reel probes | Raisafob 500 | Raisafob 940 | Raisafob 940 + added starch |
|---|---|---|---|
| Paper ash | 19.7 | 20.3 | 20.3 |
| Cobb$_{60}$, felt side | 17.5 | 20.1 | 18.8 |
| Cobb$_{60}$, wire side | 19.1 | 20.3 | 19.8 |
| HST, felt side | 1511 | 593 | 609 |
| HST, wire side | 1326 | 522 | 990 |
| Static friction | 0.634 | 0.650 | 0.610 |
| Dynamic friction | 0.453 | 0.474 | 0.452 |

These test result show that the best sizing result on papers with PCC (as exemplified with an addition giving an ash content of about 20%) can be achieved using an AKD size with a high protective colloid content. If the starch otherwise suited as a protective colloid is instead admixed with a ready AKD dispersion the results are not as good as results received when a size is used, where the protective starch colloid is admixed before the homogenization of the size composition. It is also worthwhile to note that the paper with excellent properties received with the Raisafob 500 size posses also better friction properties than the papers received with other sizes.

The papers fabricated in the above test run on the pilot paper machine were analyzed also in respect of their behaviour in ink-jet printing. These results are given in the following table:

| | Raisafob 500 | Raisafob 940 | Raisafob 940 + added starch |
|---|---|---|---|
| Ink-jet colour | | | |
| drying, seconds | 28 | 0 | 0 |
| wicking | 2.3 | 2.0 | 2.3 |
| bleeding | 4.6 | 4.6 | 5.0 |
| density, black | 0.96 | 0.88 | 0.92 |
| Ink-jet black and white | | | |
| drying, seconds | 26 | 9 | 17 |
| wicking | 4.6 | 6.6 | 6.0 |
| density, black | 1.31 | 1.21 | 1.28 |

The test results given in the previous table show that the paper fabricated using the Raisafob 500 size posses a good hydrophobicity, and despite of this, its behaviour in the ink-jet printing is not adversely affected. The size having a higher content of the protective colloid gave a better ink-jet printability than the conventional size, or the size where the protecitve colloid was admixes after the AKD was homogenized.

The starch used for the dispersion together with the hydrophobizing komponent can be produced from maize, waxy maize, wheat, tapioca, or potato, whereby, however, starches received from maize and potato are preferred. The starch must have cationic, anionic or amphoteric characteristics in order to function properly in the paper dewatering environment. The methods to provide starch with these porperties are known as such. One possibility is to chemically modify native starch.

The starches should posses viscosity properties which are relative stable in the further processing of the starch, i.e. in the production of the colloidal starch/hydrophob mixture, and in the processing of the mixture at the paper mill. The viscosity stability of starch can be improved by treating the starch for instance chemically by peroxides, ammoniumpersulphates, hypoclorite, or enzymatically.

The most critical properties of a starch suitable for the colloidal protective structure for a hydrophobizing agent are the charge potential, and the viscosity stability.

We claim:

1. An internal sizing composition for increasing the hydrophobicity of paper, which comprises a water dispersion of a ketene dimer compound and degraded starch, wherein the weight ratio of the ketene dimer and the starch is at most 1:1, on the solid weight basis.

2. A sizing composition as defined in claim 1, wherein the ketene dimer compound is selected from the group of alkyl, alkenyl, aryl and alkaryl ketene dimers.

3. A sizing composition as defined in claim 1, wherein the viscosity stability of the starch is increased by a chemical treatment.

4. A sizing composition as defined in claim 3, wherein the starch is treated chemically to posses cationic characteristics.

5. A sizing composition as defined in claim 3, wherein the starch is treated chemically to posses anionic characteristics.

6. A sizing composition as claimed in claim 3, wherein the starch is treated chemically to posses amphoteric characteristics.

7. A sizing composition as defined in claim 1, wherein the viscosity stability of the starch is increased enzymatically.

8. A sizing composition as defined in claim 1, wherein the content of the ketene dimer component is 1 to 15% of the solid weight of the composition.

9. The composition of claim 1 wherein the weight ratio of the ketene dimer and the starch is 1:1.5 to 1:2.5 on the solid weight basis.

10. A sizing composition for hydrophobizing paper by internal sizing, which composition as hydrophobizing compounds contains ketene dimer and alkenyl succinic anhydride dispersed in water together with degraded starch, wherein the weight ratio of the hydrophobizing compounds and the starch is at least 1:1, on the solid weight basis.

11. A sizing composition as defined in claim 10, wherein the alkenyl succinic anhydride is present in an amount of 20 to 70% by weight of the ketene dimer.

12. A sizing composition as defined in claim 10, wherein the alkenyl succinic anhydride is present in an amount of 30 to 50% by weight of the ketene dimer.

13. A sizing composition as defined in claim 10, wherein the content of the hydrophobizing compounds is 1 to 15% of the solid weight of the composition.

14. A sizing composition as defined in claim 10, wherein the ketene dimer compound is selected from the group of alkyl, alkenyl, aryl and alkaryl ketene dimers.

15. A sizing composition as defined in claim 10, wherein the viscosity stability of the starch is increased by a chemical treatment.

16. A sizing composition as defined in claim 10, wherein the viscosity stability of the starch is increased enzymatically.

17. A sizing composition as defined in claim 10, wherein the starch is treated chemically to posses cationic characteristics.

18. A sizing composition as defined in claim 10, wherein the starch is treated chemically to posses anionic characteristics.

19. A sizing composition as claimed in claim 10, wherein the starch is treated chemically to posses amphoteric characteristics.

20. The composition of claim 10 wherein the weight ratio of the ketene dimer and the starch is 1:1.5 to 1:2.5 on the solid weight basis.

21. A sizing composition for hydrophobizing paper by internal sizing, which composition as hydrophobizing compounds contains ketene dimer and rosin dispersed in water together with degraded starch, wherein the weight ratio of the hydrophobizing compounds and the starch is at least 1:1, on solid weight basis.

22. A sizing composition as defined in claim 21, wherein the compoisition contains fortified rosin in an amount of 20 to 50% by weight of the ketene dimer compound.

23. A sizing composition as defined in claim 21, wherein the ketene dimer compound is selected from the group of alkyl, alkenyl, aryl and alkaryl ketene dimers.

24. A sizing composition as defined in claim 21, wherein the viscosity stability of the starch is increased by a chemical treatment.

25. A sizing composition as defined in claim 21, wherein the viscosity stability of the starch is increased enzymatically.

26. A sizing composition as defined in claim 21, wherein the starch is treated chemically to posses cationic characteristics.

27. A sizing composition as defined in claim 21, wherein the starch is treated chemically to posses anionic characteristics.

28. A sizing composition as claimed in claim 21, wherein the starch is treated chemically to posses amphoteric characteristics.

29. The composition of claim 21 wherein the weight ratio of the ketene dimer and the starch is 1:1.5 to 1:2.5 on the solid weight basis.

* * * * *